United States Patent [19]

Vaguine

[11] 4,118,652

[45] Oct. 3, 1978

[54] LINEAR ACCELERATOR HAVING A SIDE CAVITY COUPLED TO TWO DIFFERENT DIAMETER CAVITIES

[75] Inventor: Victor A. Vaguine, Palo Alto, Calif.

[73] Assignee: Varian Associates, Inc., Palo Alto, Calif.

[21] Appl. No.: 777,364

[22] Filed: Mar. 14, 1977

Related U.S. Application Data

[63] Continuation-in-part of Ser. No. 546,379, Feb. 3, 1975, Pat. No. 4,024,426, which is a continuation of Ser. No. 420,754, Nov. 30, 1973, abandoned.

[51] Int. Cl.[2] ..... H01J 25/10

[52] U.S. Cl. ..... 315/5.41; 315/5.42

[58] Field of Search ..... 315/5.41, 5.42

[56] References Cited

U.S. PATENT DOCUMENTS

| | | | |
|---|---|---|---|
| 3,546,524 | 12/1970 | Stark | 315/5.41 |
| 3,906,300 | 9/1975 | Trans | 315/5.41 |
| 4,006,422 | 2/1977 | Schriber | 315/5.41 |

*Primary Examiner*—Saxfield Chatmon, Jr.
*Attorney, Agent, or Firm*—Leon F. Herbert; Stanley Z. Cole

[57] ABSTRACT

In the field of side-cavity coupled accelerators the accelerating cavity to which the accelerating power input is connected has preferably a smaller diameter than the other accelerating cavities. A side cavity is connected by a separate passage to the accelerating cavities of different diameter it couples together, whereby the areas of the coupling irises formed where said passages enter said accelerating cavities can be independently controlled by selecting the length of the respective passage. This separate passage arrangement is particularly described in an accelerator which comprises a plurality of interlaced substructures, with each substructure having a plurality of accelerating cavities disposed along the particle beam path and having side cavities disposed away from the beam path for electromagnetically coupling the accelerating cavities. A standing radio-frequency electromagnetic wave is fed to an accelerating cavity in each substructure so there are plural driven cavities in a single accelerator. Thus, the separate coupling passage arrangement between the side cavity and the accelerating cavities it couples is particularly valuable in said multiple substructure arrangement.

4 Claims, 6 Drawing Figures

LINEAR ACCELERATOR HAVING A SIDE CAVITY COUPLED TO TWO DIFFERENT DIAMETER CAVITIES

CROSS-REFERENCE TO RELATED APPLICATIONS

This is a continuation-in-part of U.S. patent application Ser. No. 546,379 filed Feb. 3, 1975, now U.S. Pat. No. 4,024,426 which is a continuation of Ser. No. 420,754, filed Nov. 30, 1973, now abandoned.

BACKGROUND OF THE INVENTION

This invention is a further development in the standing-wave linear charged particle accelerator art. More specifically the invention is an improvement upon the side-cavity coupled accelerator configuration as described by E. A. Knapp, B. C. Knapp and J. M. Potter in an article entitled "Standing Wave High Energy Linear Accelerator Structures", 39 *Review of Scientific Instruments* 979 (1968); and as further described in U.S. Pat. No. 3,546,524 to P. G. Stark.

SUMMARY OF THE INVENTION

The accelerating cavities of two or more independent side-cavity coupled substructures are interlaced to form a single overall accelerator structure, with one accelerating cavity of each substructure being driven with radio-frequency power in phased relation with the other substructures. This arrangement permits operation at higher power levels without radio-frequency breakdown, and increases the portion of the beam path along which the beam is acted upon by the radio-frequency field, as compared to single-substructure side-cavity coupled accelerators such as disclosed in the above-mentioned article by Knapp et al. Each substructure is preferably operated in the $\pi/2$ mode. The $\pi/2$ mode means each side cavity is 90° out of phase with each of the accelerating cavities to which it is coupled, and adjacent accelerating cavities in a given substructure are 180° out of phase. The accelerating cavities which are driven with RF power are made smaller in diameter than the other accelerating cavities in order to compensate for the detuning effect of the coupling iris. The side cavities are connected by separate passages to the accelerating cavities they couple together whereby the coupling irises formed where said passages enter said accelerating cavities can be made of substantially equal areas for both the large and small diameter accelerating cavities by making said passage longer for the smaller diameter accelerating cavity.

One of the objects of this invention is to provide an improved accelerator comprising interlaced side-cavity coupled substructures.

Another object is to provide a side-cavity coupled accelerator structure in which the accelerating cavity which is driven from the RF power source is of smaller diameter than the accelerating cavity to which it is coupled by a side cavity, and said side cavity is connected to each of the cavities it couples together by means of a separate passage.

Other objects and advantages of this invention will be apparent upon a reading of the following specification in conjunction with the accompanying drawing.

DESCRIPTION OF A PREFERRED EMBODIMENT

Figure 1:
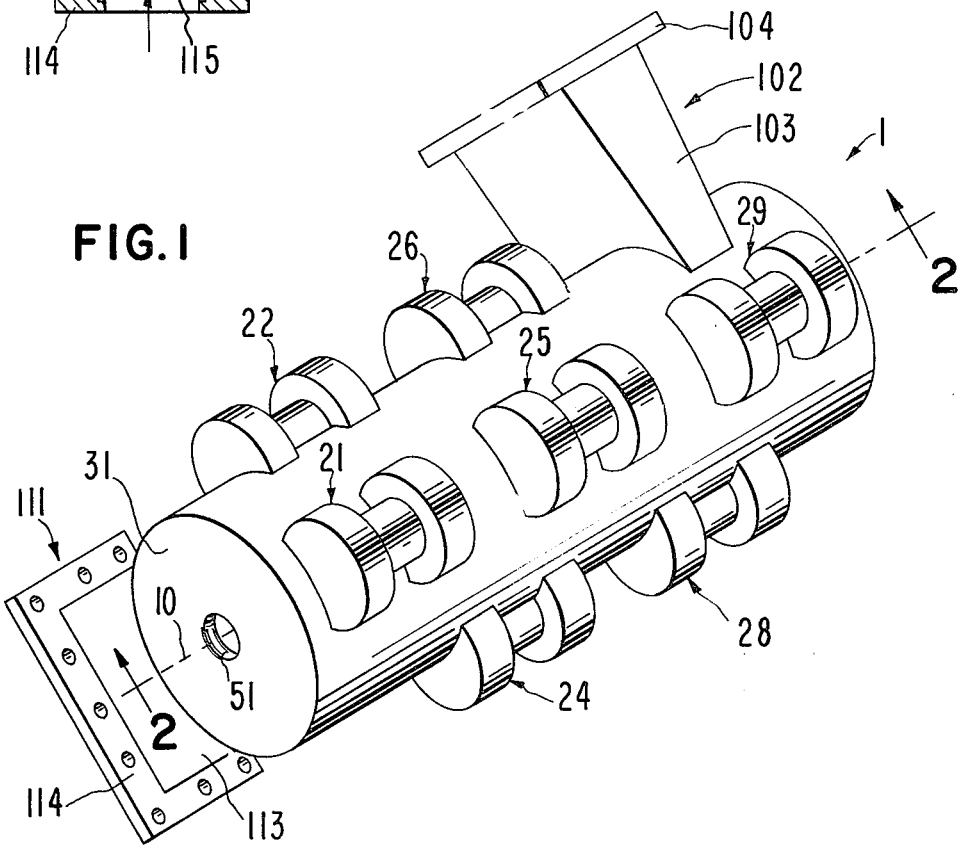
FIG. 1 is an oblique view of a standing-wave linear particle accelerator having two independent side-cavity coupled substructures interlaced according to this invention.

FIG. 1 shows an oblique view of a preferred embodiment of a standing-wave linear particle accelerator according to the teaching of this invention. The accelerator 1 has two interlaced side-cavity coupled standing-wave substructures with the side cavities of each substructure being disposed orthogonally with respect to the side cavities of the other substructure along a common axis 10. The axis 10 also defines the path of the charged particle beam through the accelerator 1. Each substructure comprises a series of accelerating cavities, with the accelerating cavities of one substructure being interlaced with the accelerating cavities of the other substructure as will be discussed in connection with FIGS. 2 and 3. For each substructure, the accelerating cavities are inductively coupled by side cavities. The side cavities are seen in FIG. 1 as projections from the generally cylindrical overall configuration of the accelerator 1. The accelerating cavities of one substructure, hwoever, are electromagnetically discoupled from the accelerating cavities of the other substructure.

Also shown in FIG. 1 are radio-frequency power input guides 102 and 111 for energizing, respectively, each of the standing-wave substructures. A conventional charged particle source, e.g., an electron gun, not shown, injects a beam of charged particles through a beam entrance aperture 51 into the accelerator 1 along axis 10 from left to right as viewed in FIGS. 1, 2 and 3. The charged particles which are in phase with the accelerating field in the first accelerating cavity are captured and bunched. The formed bunch of the charged particles will pass through each successive accelerating cavity during a time interval when the electric field intensity in that cavity is a maximum. It is desirable that in each accelerating cavity the particles experience the maximum electric field intensity possible for the particular power level at which the accelerator 1 is being operated. In that way, the electromagnetic interaction of the charged particles with the electric field will result in the greatest possible transfer in energy from the field to the particles.

Figure 2:
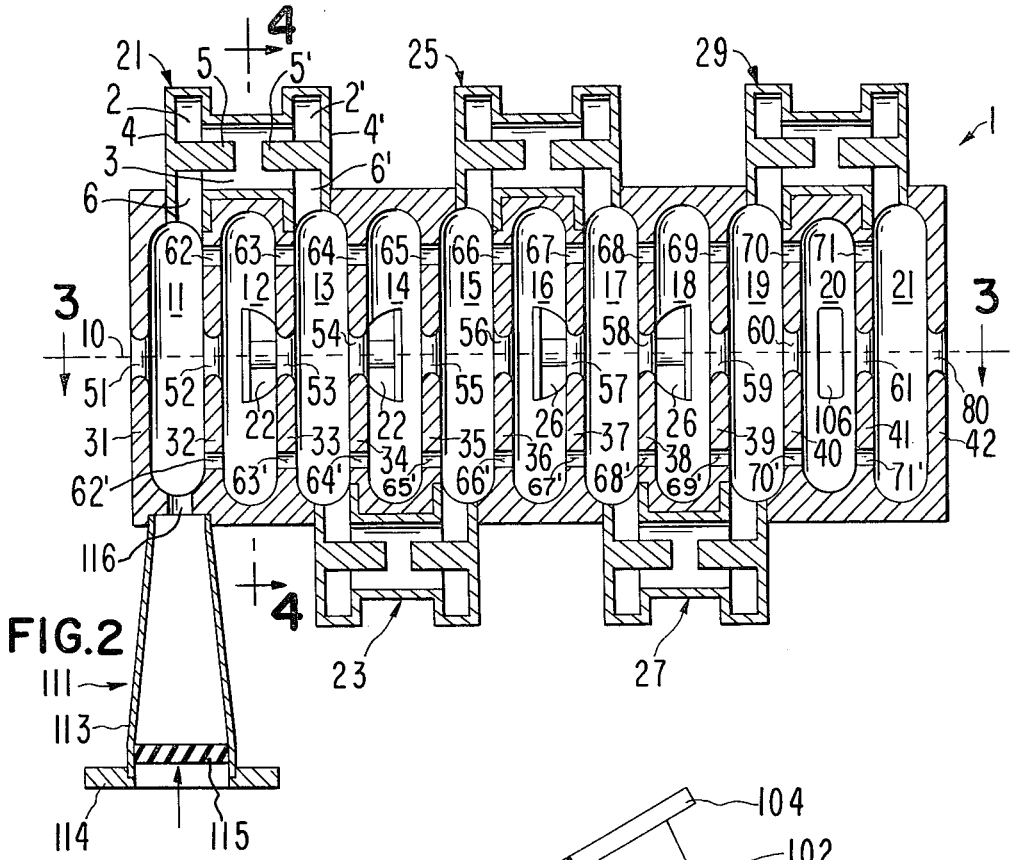
FIG. 2 is a sectional view of the accelerator taken on line 2—2 of FIG. 1.
Figure 3:
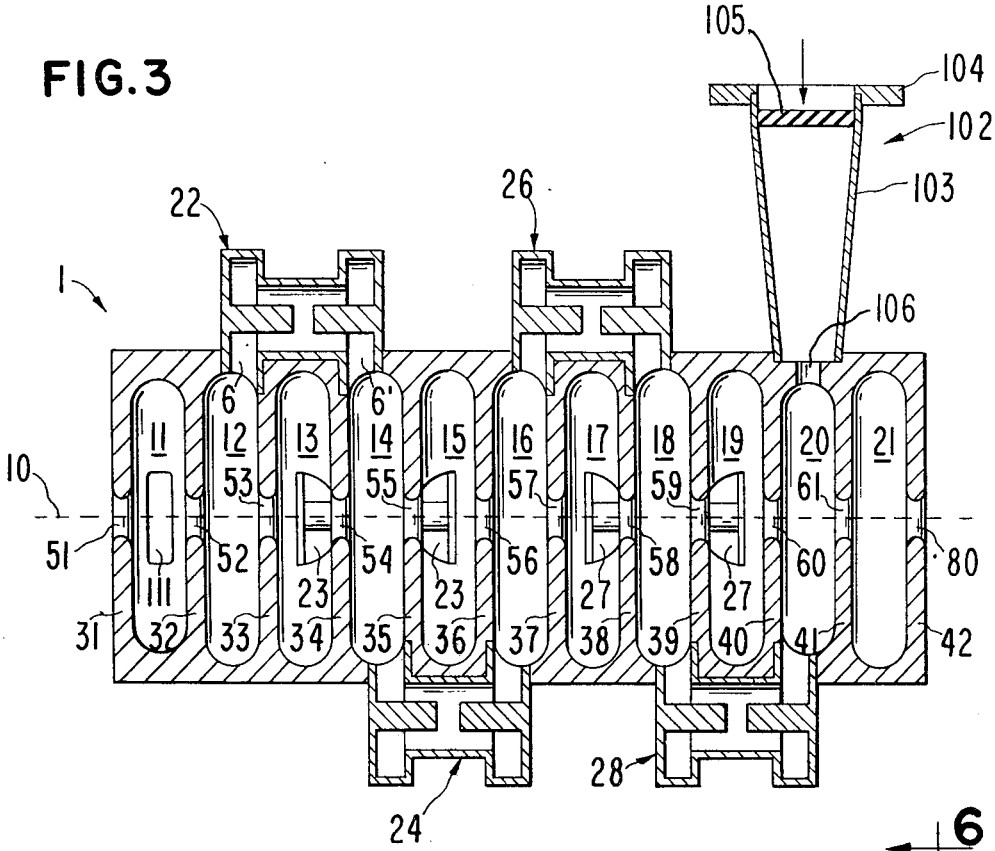
FIG. 3 is a sectional view of the accelerator taken on line 3—3 of FIG. 2.

FIG. 2 shows a cross-sectional view of accelerator 1 along the axis 10 of the particle beam. In the particular embodiment shown, there are eleven accelerating cavities 11, 12, 13, 14, 15, 16, 17, 18, 19, 20, 21. The odd-numbered accelerating cavities (11, 13, 15, 17, 19, and 21) form one standing-wave substructure, and the even-numbered (12, 14, 16, 18 and 20) accelerating cavities form another independent standing-wave substructure. The odd-numbered accelerating cavities are electrically coupled together by side cavities 21, 23, 25, 27 and 29. FIG. 3 shows another cross-sectional view of accelerator 1 along the axis 10 of the particle beam, orthogonal to the cross-sectional view of FIG. 2. In FIG. 3, the even-numbered accelerating cavities are shown electrically coupled together by side cavities 22, 24, 26 and 28. Each of the accelerating cavities 11 through 21 has a cylindrical configuration, and all these accelerating cavities are coaxially aligned along the axis 10.

The first cavity 11 has an entrance wall 31 which extends perpendicular to the beam axis 10 and includes a circular beam entrance aperture 51 disposed coaxially with respect to the beam axis 10. A second wall 32, which also extends perpendicular to the beam axis 10, serves as a common wall between the accelerating cavity 11 and the accelerating cavity 12. The wall 32 also includes a central circular aperture 52 which is coaxially aligned with aperture 51 along the beam axis 10. The common wall 32 additionally includes a pair of magnetic coupling apertures 62 and 62' which are symmetrically disposed with respect to each other on opposite sides of the central aperture 52. These magnetic coupling apertures are located near the outer periphery of the wall 32, adjacent the regions in cavities 11 and 12 where the magnetic field approaches a maximum value and the electric field is very small. In principle, magnetic coupling between cavities 11 and 12 could be provided by a single coupling hole or by a plurality of coupling holes arranged, for example, in annular fashion around the outer periphery of wall 32. However, it has been found that the two diametrically opposed coupling holes 62 and 62' as shown in FIG. 2, of a size on the same order as the size of the central beam aperture 52, will provide adequate magnetic coupling between the adjacent cavities 11 and 12 to compensate for undesirable electric coupling through the central aperture 52. The net effect of the coupling of energy from cavity 11 into cavity 12 through aperture 52 is effectively cancelled by the simultaneous coupling of energy from cavity 12 back into cavity 11 through the magnetic coupling apertures 62 and 62'. As illustrated in FIGS. 2 and 3, the edges of the apertures 51 and 52 are rounded in order to reduce the electric field gradient at these apertures to a lower value than would result if drift tubes or non-rounded iris openings were provided.

The accelerating cavity 12 includes another wall 33 which serves as a common wall between cavity 12 and the next accelerating cavity 13. The wall 33 has a central aperture 53 which is coaxial with the beam axis 10, and a pair of magnetic coupling apertures 63 and 63' which are symmetrically disposed on opposite sides of the central aperture 53 in order to provide magnetic coupling between cavities 12 and 13 so as to compensate for any electrical coupling between these cavities through central aperture 53. The edges of the aperture 53 are rounded, as discussed above in connection with apertures 51 and 52, to reduce the electric field gradient at the iris openings between adjacent accelerating cavities.

The cavities 13, 14, 15, 16, 17, 18, 19, 20 and 21 include common walls 34, 35, 36, 37, 38, 39, 40 and 41, respectively, disposed between adjacent cavities so that all of the cavities are aligned along the beam axis 10. The common walls 34, 35, 36, 37, 38, 39, 40 and 41 each include one of a plurality of central beam apertures 54, 55, 56, 57, 58, 59, 60 and 61, respectively, which are also coaxially aligned with each other about the beam axis 10. Each of the walls 34, 35, 36, 37, 38, 39, 40 and 41 additionally includes a pair of magnetic coupling apertures 64 and 64', 65 and 65', 66 and 66', 67 and 67', 68 and 68', 69 and 69', 70 and 70', and 71 and 71', respectively, which are symmetrically disposed on opposite sides of the central apertures 54, 55, 56, 57, 58, 59, 60 and 61, respectively, and serve to magnetically couple the adjacent acclerating cavities 13 and 14, 14 and 15, 15 and 16, 16 and 17, 17 and 18, 18 and 19, 19 and 20, and 20 and 21, respectively. This magnetic coupling of adjacent cavities compensates for any electric coupling that occurs through the central beam apertures in the walls separating the adjacent cavities. The beam apertures 54, 55, 56, 57, 58, 59, 60 and 61 are likewise rounded to reduce the electric field gradient at the iris openings between adjacent acclerating cavities. An exit wall 42 having a central beam exit aperture 80 aligned with the beam axis 10 is disposed on the opposite side of the accelerating cavity 21 from the wall 41 and serves to complete the accelerating cavity structure. It is noted that the accelerator 1 is an evacuated structure. For the embodiment shown in the drawing, it is necessary that the beam entrance aperture 51 and the beam exit aperture 80 be covered by windows which are impermeable to gas in order that vacuum-tight integrity of the structure can be maintained yet which are permeable to the beam particles at the energies at which these particles respectively enter into or exit from the accelerator 1. An alternative arrangement with respect to the beam entrance aperture 51 would be to dispose a preaccelerator structure, or the charged particle source, immediately adjacent the aperture 51, such as by a vacuum-tight flange connection, in such a way that charged particles could be injected directly through aperture 51 into the evacuated accelerator 1 without the necessity of any window material covering the aperture 51. In an x-ray device the closure wall for aperture 80 would carry an x-ray generating target to be struck by the beam passing through aperture 80. If the accelerator is used only for charged particles that can be collimated into a very narrow beam, it is possible for the central beam apertures to be made so small that electrical coupling between adjacent accelerating cavities will be negligible. In that case, the magnetic coupling cavities are unnecessary and can be eliminated.

The accelerating cavity 11 in inductively coupled through a side cavity 21 to the accelerating cavity 13, as shown in FIG. 2. A second side cavity 22, as shown in FIG. 3, is disposed 90° around the beam axis 10 from side cavity 21 and provides similar inductive coupling between the two accelerating cavities 12 and 14. A third side cavity 23, as shown in FIG. 2, is disposed 90° around the beam axis 10 beyond side cavity 22 and provides coupling between the two accelerating cavities 13 and 15. A fourth side cavity 24 is disposed 90° around the beam axis 10 beyond side cavity 23 and provides coupling between the two accelerating cavities 14 and 16. In a like manner, a fifth side cavity 25 is disposed 90° around the beam axis 10 beyond side cavity 24, in alignment with the side cavity 21, and provides coupling between the two accelerating cavities 15 and 17. Similarly, a sixth side cavity 26 is disposed 90° around the beam axis 10 beyond side cavity 25, in alignment with the side cavity 22, and provides coupling between the two accelerating cavities 16 and 18. A seventh side cavity 27 is disposed an additional 90° around the beam axis 10, in alignment with the side cavity 23, and provides coupling between the accelerating cavities 17 and 19. Similarly, an eighth side cavity 28 is disposed an additional 90° around the beam axis 10 beyond side cavity 27, in alignment with the side cavity 24, and provides coupling between the two accelerating cavities 18 and 20. A ninth side cavity 29 is disposed 90° further around the beam axis 10, in alignment with side cavities 21 and 25, and provides coupling between the two accelerating cavities 19 and 21.

Figure 4:
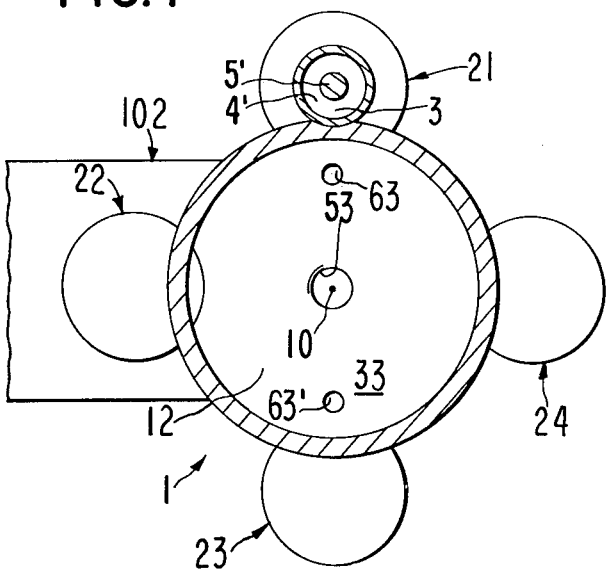
FIG. 4 is a sectional view of an accelerating cavity of the accelerator taken on line 4—4 of FIG. 2.

The side cavities 21–29 are preferably all of the same design although for the purpose of proper coupling to accelerating cavities of different diameters, only the side cavities which couple to the driven accelerating cavities require the specific construction which will now be described with reference to side cavity 21 in FIG. 1. Instead of being configured as a single cylinder according to the conventional manner, the side cavities are each configured as a combination of three coaxial cylinders 2, 3 and 2'. One end of cylinder 2 is bounded by wall 4, and the other end is in open communication with cylinder 3. Cylinder 3 is coaxial with but of smaller diameter than cylinders 2 and 2', and is in open communication at each end with cylinders 2 and 2' to form the interior chamber of the side cavity 21. Cylinder 2' has the same diameter and axial length as cylinder 2, and is bounded by wall 4' on the end opposite cylinder 3. The axial length of cylinder 3 is equal to the distance between the outside surfaces of walls 32 and 33 of the accelerating cavity 12, as seen in FIG. 2. The diameter of cylinder 3 is less than the diameter of cylinders 2 and 2'. Metal post 5 projecting from wall 4 and metal post 5' projecting from wall 4' are symmetrically disposed along the common axis of cylinders 2, 3, and 2' whereby the gap between posts 5 and 5' can provide the capacitance necessary for tuning the side cavity 21 to the same frequency as the accelerating cavities 11 and 13. FIG. 4 shows in detail a cross-sectional view through accelerating cavity 12 and side cavity 21. The lower portions of cylinders 2 and 2' are open to form coupling passages 6 and 6'. Thus cavity 21 communicates with accelerating cavity 11 through passage 6 and with accelerating cavity 13 through passage 6', which passages form inductive coupling irises where they open into the accelerating cavities 11 and 13. The accelerating cavities and the side coupling cavities of a particular substructure are all tuned to be resonant at essentially the same frequency. For practical application, it is contemplated that the cavities will be resonant at S-band.

As illustrated in FIGS. 1 and 3, a first radio-frequency power input waveguide 102 communicates with the accelerating cavity 20 through iris 106 for coupling energy to the even-numbered accelerating cavities. The waveguide 102 comprises a rectangular guide member 103, a mounting flange 104 affixed thereto, and a radio-frequency window 105 sealed thereacross to permit passage of radio-frequency energy into the accelerating cavity 20 while forming a portion of the vacuum envelope of the accelerator 1. Similarly, a second radio-frequency power input waveguide 111, comprising a rectangular guide member 113, a mounting flange 114, and a radio-frequency window 115, communicates with the accelerating cavity 11 through iris 116 for coupling energy to the odd-numbered accelerating cavities. As previously stated it is desirable to make driven cavities such as 11 and 20 of smaller diameter than the non-driven accelerating cavities in order to compensate for the detuning effect of the power coupling irises such as 106 and 116. In principle, radio-frequency energy could be coupled to any one of the accelerating cavities of each substructure to set up a standing wave in that substructure. It is convenient, however, to locate the power input waveguides 102 and 111 at opposite ends of the accelerator 1 in order to accommodate the physical dimensions of the waveguides.

Since the substructure comprising the accelerating cavities 11, 13, 15, 17, 19 and 21 is electromagnetically discoupled from the substructure comprising the accelerating cavities 12, 14, 16, 18 and 20, each substructure could be energized to support a standing wave of a different frequency. However, it is contemplated that the same frequency input power will ordinarily be coupled into each substructure. For a two-substructure accelerator as shown in the drawing with each substructure operating in the $\pi/2$ mode, maximum energy can be transferred to the beam of charged particles, and hence, the maximum output beam energy can be obtained, when the standing wave in one substructure is out of phase with the standing wave in the other substructure by 90° (i.e., when the phase of the accelerating field in cavity 12 lags the phase of the accelerating field in cavity 11 by 90°). The charged particles are synchronized with the radio-frequency accelerating fields through the entire length of the accelerator by well-known techniques which take into account the length of the accelerating cavities and the frequency of the field. For an accelerator having a number of independent substructures greater than two, and each substructure operating in the $\pi/2$ mode, the maximum output beam energy can be obtained when each successive downstream substructure is dephased to lag the next preceding upstream substructure by 180° divided by N (where N is the number of substructures). Thus, for a charged particle beam of a given intensity, by adjusting the dephasing between adjacent accelerating cavities it is possible to adjust the output beam energy of the accelerator from a maximum value down to a value approximately equal only to the energy possessed by the particles as they enter the accelerator. The general statement of phase difference ($P_c$) between adjacent accelerating cavities of the combined accelerator of this invention for maximum energy gain, regardless of the mode of operation of the individual substructures, or number of substructures (N), is given by the expression $P_c = P_s/N$ (where $P_s$ is the phase difference between adjacent accelerating cavities of each individual substructure).

Although the illustrated embodiments of the invention show only two interlaced substructures, it is clear that three, four, or even more substructures can be similarly interlaced.

Figure 5:
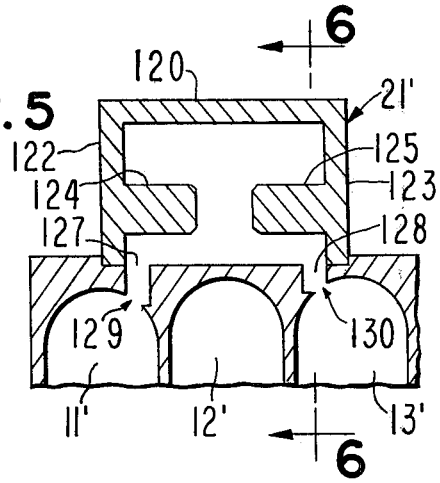
FIG. 5 is a sectional view similar to the upper left portion of the accelerator of FIG. 2 and particularly showing a modified construction for the side cavity.
Figure 6:
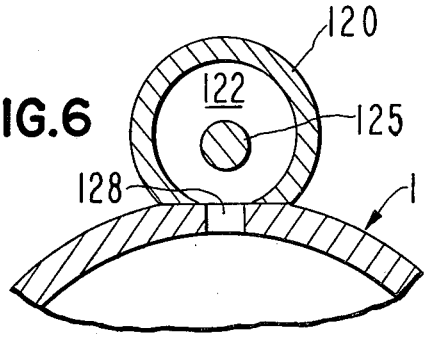
FIG. 6 is a sectional view on line 6—6 of FIG. 5.

FIG. 5 is a view similar to the upper left portion of FIG. 2 but showing a modified design for the side cavities represented by cavity 21'. Cavity 21' comprises a cylindrical side wall 120 and opposite end walls 122 and 123. Metal posts 124 and 125 project inwardly from the end walls to provide capacitive tuning as described for posts 5 and 5' in side cavity 21. As shown in FIG. 6, the periphery of cylinder 120 nearest the center of accelerator 1 is cut away and joined to a flattened portion on the periphery of accelerator 1. The space within cylinder 120 communicates with the accelerating cavities 11' and 13' by means of passages 127 and 128 to form iris openings 129 and 130, respectively. Passages 127 and 128 are both of circular cross section and both have the same diameter. The coupling between an accelerating cavity and its side cavity is, to a first order effect, a function of the area of the iris opening. Since accelerator cavity 11' is of smaller diameter than accelerating cavity 13', it will be seen that if passages 127 and 128 were of equal length the area of iris 129 would be less than that of iris 130. The versatility of the separate two-passage connection from the side cavity to its accelerating cavities permits the lengths of the passages 127 and 128 to be selected to provide irises 129 and 130 of equal area. Similarly, the lengths of passages 6 and 6' in FIG. 2 can be selected to provide iris openings of equal area. Differences other than or combined with different lengths of the separate passages can also be considered for obtaining equal area for the irises 129 and 130. For example, if space permits it is also possible to make the passage 127 to the smaller diameter accelerating cavity have a larger cross section than the passage 128 to the larger diameter accelerating cavity in order to make iris openings 129 and 130 have the same area.

Although this invention has been described with respect to preferred embodiments, it will be readily apparent to those skilled in the art that various changes in form and arrangement of parts may be made to suit requirements without departing from the spirit and scope of the invention as defined by the following claims.

What is claimed is:

1. An accelerator for charged particle beams comprising wall means forming a plurality of resonant accelerating cavities, beam-passage apertures formed in said wall means between adjacent accelerating cavities, a resonant coupling cavity external to and interconnecting two of said accelerating cavities, one of said two accelerating cavities having a coupling iris in a region of its wall remote from said beam-passage aperture, said coupling iris connecting to a transmission means for injecting electromagnetic wave energy into said one accelerating cavity, said one of said two accelerating cavities having a smaller diameter than the other accelerating cavity, a first coupling passage from said coupling cavity to said one accelerating cavity, and a second coupling passage from said coupling cavity to said other accelerating cavity.

2. An accelerator as claimed in claim 1 wherein there are plural substructures each having two of said accelerating cavities interconnected by an external resonant coupling cavity, accelerating cavities of one substructure which are coupled together by one of said coupling cavities being separated from each other by an accelerating cavity of at least one other substructure.

3. An accelerator as claimed in claim 1 wherein said coupling passages are different from each other whereby the coupling between each of said two accelerating cavities and said coupling cavity is equalized.

4. An accelerator as claimed in claim 3 wherein the coupling passage to said smaller diameter accelerating cavity is longer than the other coupling passage.

* * * * *